US007057586B2

(12) United States Patent
Moon

(10) Patent No.: US 7,057,586 B2
(45) Date of Patent: Jun. 6, 2006

(54) FLAT PANEL DISPLAY AND OPERATION METHOD THEREOF

(75) Inventor: Seong Hak Moon, Gunpo (KR)

(73) Assignee: LG Electronics Inc., Seoul (KR)

( * ) Notice: Subject to any disclaimer, the term of this patent is extended or adjusted under 35 U.S.C. 154(b) by 150 days.

(21) Appl. No.: 10/100,081

(22) Filed: Mar. 19, 2002

(65) Prior Publication Data

US 2002/0135548 A1 Sep. 26, 2002

(30) Foreign Application Priority Data

Mar. 20, 2001 (KR) ..... 2001-14218
Mar. 23, 2001 (KR) ..... 2001-15241

(51) Int. Cl.
*G09G 3/20* (2006.01)
*G09G 3/22* (2006.01)

(52) U.S. Cl. ..... 345/75.2; 345/213

(58) Field of Classification Search ..... 345/74.1–83, 345/204–215, 87–103
See application file for complete search history.

(56) References Cited

U.S. PATENT DOCUMENTS 4,499,459 A * 2/1985 Sasaki et al. ..... 345/55
4,779,085 A * 10/1988 Mizutome et al. ..... 345/92
6,229,516 B1 * 5/2001 Kim et al. ..... 345/103
6,545,655 B1 * 4/2003 Fujikawa ..... 345/87
2001/0003448 A1 * 6/2001 Nose et al. ..... 345/99

FOREIGN PATENT DOCUMENTS

JP 07-023316 * 1/1995

* cited by examiner

*Primary Examiner*—Alexander Eisen
(74) *Attorney, Agent, or Firm*—Fleshner & Kim, LLP

(57) ABSTRACT

In a flat panel display and an operation method thereof capable of lowering a capacitance of a pixel cell, an operation method of a flat panel display includes supplying a data pulse to first data lines of the panel, supplying a data pulse to second data lines of the panel and supplying a scan pulse to scan lines by being synchronized with the data pulse supplied to the first and the second data lines. In addition, an operation method of a flat panel display includes operating a left region of a panel after dividing the panel into two regions and operating a right region of the panel.

20 Claims, 9 Drawing Sheets

FLAT PANEL DISPLAY AND OPERATION METHOD THEREOF

BACKGROUND OF THE INVENTION

1. Field of the Invention

The present invention relates to a flat panel display, and in particular to a flat panel display and an operation method thereof which are capable of lowering a capacitance of a pixel cell.

2. Description of the Prior Art

Recently, various flat display devices having a light weight and a small volume of a CRT (cathode ray tube) have been developed. There are a LCD (liquid crystal display), a FED (field emission display), a plasma display panel and an electro-luminescence, etc. In order to improve a display quality, researches and developments in brightness, contrast and colorimetric purity of a flat display device have been performed actively.

The FED (field emission display) is divided into a tip type FED (field emission display) emitting electrons by concentrating a high electric field to an acuminate emitter by using a quantum-mechanical tunnel effect and a MIM (metal insulator metal) type FED (field emission display) emitting electrons by concentrating a high electric field to a metal having a certain area by using a quantum-mechanical tunnel effect.

FIG. 1 is a perspective view illustrating the conventional tip type FED (field emission display).

FIG. 2 is a sectional view illustrating the tip type FED (field emission display) of FIG. 1.

As depicted in FIGS. 1 and 2, the tip type FED (field emission display) includes an upper glass substrate 2 laminated an anode electrode 4 and a phosphor 6 and an electric field emission array 32 formed on a lower glass substrate 8. The electric field emission array 32 is constructed with a cathode electrode 10 and a resistance layer 12 formed on the lower glass substrate 8, a gate insulating layer 14 and an emitter 22 formed on the resistance layer 12 and a gate electrode 16 formed on the gate insulating layer 14.

The cathode electrode 10 supplies a current to the emitter 22, the resistance layer 12 restricts an exceed current applied from the cathode electrode 10 to the emitter 22 in order to supply a uniform current to the emitter 22.

The gate insulating layer 14 insulates the cathode electrode 10 and the gate electrode 16. The gate electrode 16 is used as an emission electrode for emitting electrons. A spacer 40 is installed between the upper glass substrate 2 and the lower glass substrate 8.

The spacer 40 supports the upper glass substrate 2 and the lower glass substrate 8 so as to maintain a high vacuum state between them.

In order to display a picture, a −cathode voltage is applied to the cathode electrode 10, and +anode voltage is applied to the anode electrode 4. And, +gate voltage is applied to the gate electrode 16. Then, an electron beam 30 emitted from the emitter 22 clashes against the RGB (red•green•blue) phosphor 6, accordingly the phosphor 6 is excited. Herein, a visible light as one of red•green•blue•colors is emitted according to the phosphor 6.

In the above-described tip type FED (field emission display), a quantity of emitted electrons is determined according to characteristics of an emitter used in electron emission. Accordingly, all emitters included in one FED have to be made uniformly. However, in the present production process, it is difficult to make all emitters have uniform characteristics. In addition, lots of production time is required to produce an emitter.

In addition, in the tip type FED (field emission display), because electrons are emitted from the acuminate emitter, it is difficult to reduce a gap between the cathode electrode 10 and the gate electrode 16, accordingly a high voltage as 30 ~100 volt has to be applied between the two electrodes.

Therefore, power consumption is high due to the voltage applied to the cathode electrode 10 and the gate electrode 16.

FIGS. 3A and 3B illustrate a pixel cell of the conventional MIM (metal insulator metal) type FED (field emission display).

As depicted in FIGS. 3A and 3B, a pixel cell of the MIM type FED (field emission display) is constructed with an upper substrate 42 laminated an anode electrode 44 and a phosphor 46 and an electric field emission array 56 formed on a lower substrate 48.

The electric field emission array 56 is constructed with a scan electrode 50, an insulating layer 52 and a data electrode 54 formed on the lower substrate 48.

In order to display a picture, −scan pulse is applied to the scan electrode 50, and +data pulse is applied to the data electrode 54. And, +anode voltage is applied to the anode electrode 44. Then, tunneling of electrons from the scan electrode 50 to the data electrode occurs, accordingly the electrons are accelerative toward the anode electrode 44.

The electrons clash against the RGB phosphor 46, and the phosphor 46 is excited. Herein, a visible light as one of red•green•blue colors is emitted according to the phosphor 46.

In the above-described MIM type FED (field emission display), because a distance between the scan electrode 50 and the data electrode 54 is very near in comparison with the tip type FED (field emission display), it is possible to fabricate an insulating layer as a thin layer, accordingly it can be operated at a voltage lower than a voltage of the tip type FED (field emission display). In other words, voltage as 3~10 volt is applied to the scan electrode 50 and the data electrode 54 of the MIM type FED (field emission display). In addition, in the MIM type FED (field emission display), because the scan electrode 50 and the data electrode 54 emitting electrons have a certain area, it is possible to fabricate the scan electrode 50 and the data electrode 54 by a simple fabrication process in comparison with the tip type FED.

FIG. 4 is a wave diagram illustrating an operational wave supplied to the conventional MIM type FED (field emission display).

As depicted in FIG. 4, in the conventional MIM (metal insulator metal) type FED (field emission display), −scan pulse (SP) is sequentially supplied to a scan line (S), and +data pulse (DP) synchronized with the −scan pulse (SP) is supplied to a data line (D). A pixel cell receiving the scan pulse (SP) and the data pulse (DP) emits electrons by a voltage difference between the scan pulse (SP) and the data pulse (DP). It will be described in more detail with reference to accompanying FIG. 5.

FIG. 5 illustrates a FED (field emission display) at which pixel cells of FIGS. 3A and 3B are arranged as a matrix format.

As depicted in FIG. 5, when −5V scan pulse (SP) is applied to a first scan line (S1) and 5V data pulse (DP) is applied to the data line (D), a voltage difference as 10V is generated in first pixel cells (P1) formed at the first scan line (S1). Accordingly, electrons are emitted from the first pixel cells (P1). Herein, by supplying different data value to cells (D1~Dn) of the data line (D), each pixel cell can be on/off.

In more detail, each pixel cell placed at a cross point of the scan line(S1) and the cells (D1~Dn) of the data line (D) is on/off according to a data line value.

Herein, a width and/or amplitude of the data pulse (DP) can be differently set according to a gray scale. For example, in description of a high gray scale, a width and/or amplitude of the data pulse (DP) is set as wide and/or high, in description of a low gray scale, a width and/or amplitude of the data pulse (DP) is set as narrow and/or low.

In the meantime, only data pulse (DP) is applied to second~mth pixel cells (P2~Pm) formed on second~mth scan lines (S2~Sm), electrons are not emitted from the second~mth pixel cells (P2~Pm).

After that, a picture can be displayed by operating the first~the mth pixel cells (P1~Pm) by sequentially applying the scan pulse (SP) and the data pulse (DP) (herein, DP is a whole value of D1~Dn) up to the mth scan line (Sm). After displaying the picture, +reset pulse (RP) is applied to the first~the mth scan lines (S1~Sm). Then, electric charges charged in the first~the mth pixel cells (P1~Pm) are eliminated.

However, as depicted in FIGS. 3A and 3*b*, in the MIM type FED (field emission display) constructed with the scan electrode 50, the insulating layer 52 and the data electrode 50, the insulating layer 52 as an intermediate layer is very thin. In more detail, in $C=\in\times s/d$ (herein, $\in$ is a dielectric constant, d is a dielectric constant width and s is a cell area), because a dielectric substance layer is very thin, "C" element is largely increased. In more detail, because it is constructed as a capacitor structure, a pixel cell (P) has a high capacitance. Particularly, when the scan pulse (SP) is supplied to the all pixel cells (D1~Dn) formed on one scan line (S), an operational velocity is lowered by a capacitance value of the pixel cells (D1~Dn). In addition, a voltage drop occurs due to a high current.

For example, when the scan pulse (SP) is supplied to a MIM type FED (field emission display) of 1920×480, the scan pulse (SP) and the data pulse (DP) are supplied to 1920 pixel cells. Herein, the pixel cells receiving the scan pulse (SP) and the data pulse (DP) have a certain capacitance value, the scan line (S) has a capacitance adding each capacitance value of the 1920 pixel cells. Accordingly, in the conventional MIM type FED (field emission display), a high velocity operation can not be performed due to a high capacitance. In more detail, it is difficult to perform a high velocity operation in the MIM type FED (field emission display) having a large screen.

SUMMARY OF THE INVENTION

Accordingly, it is an object of the present invention to provide a flat panel display and an operation method thereof which are capable of lowering a capacitance of a pixel cell.

It is another object of the present invention to provide a flat panel display and an operation method thereof which are capable of preventing voltage lowering of a scan line.

It is yet another object of the present invention to provide a flat panel display and an operation method thereof which are capable of improving a uniformity of a screen.

It is still another object of the present invention to provide a flat panel display capable of being operated at a high velocity and an operation method thereof.

In order to achieve the above-mentioned objects, in an operation method of a flat panel display including data lines and scan lines and being operated by frame units, an operation method of a flat panel display includes supplying a data pulse to first data lines of a panel, supplying a data pulse to second data lines of the panel and supplying a scan pulse to scan lines by being synchronized with the data pulse supplied to the first and the second data lines.

A flat panel display includes a first data operating unit for supplying odd data to odd-numbered data lines and a second data operating unit for supplying even data to even-numbered data lines so as to alternate with the odd data.

An operation method of a flat panel display includes operating a left region of a panel after dividing the panel into two regions and operating a right region of the panel.

A flat panel display includes data electrodes, first scan electrodes formed at a left region of a panel so as to cross the data electrodes and second scan electrodes formed at a right region of the panel so as to be corresponded to the first scan electrodes and cross the data electrodes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the Drawings.

DETAILED DESCRIPTION OF THE PREFERRED EMBODIMENT

Hereinafter, preferred embodiments of a flat panel display and an operation method thereof capable of lowering a capacitance of a pixel cell will be described with reference to accompanying FIGS. 6~13.

Figure 1:
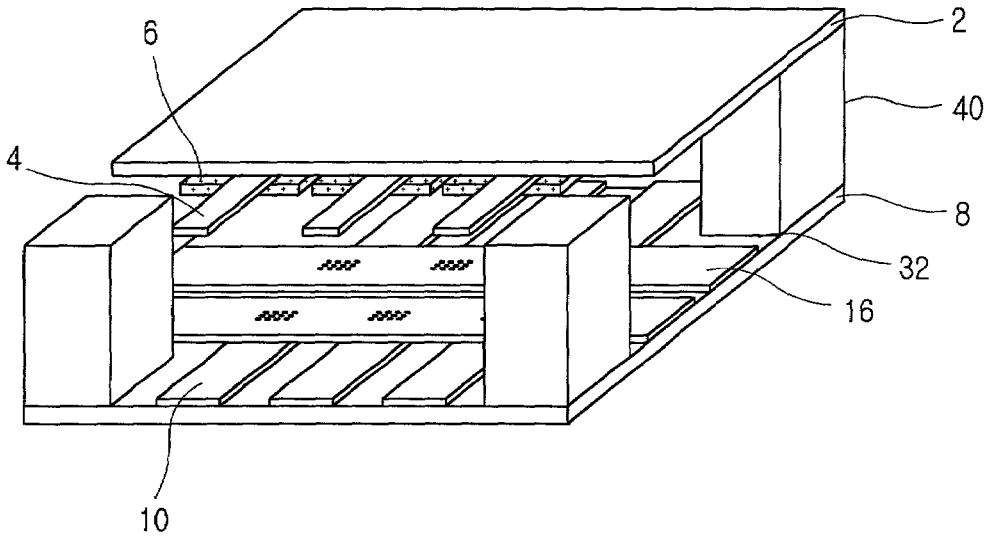
FIG. 1 CONVENTIONAL ART
FIG. 1 is a perspective view illustrating the conventional tip type FED (field emission display)
Figure 2:
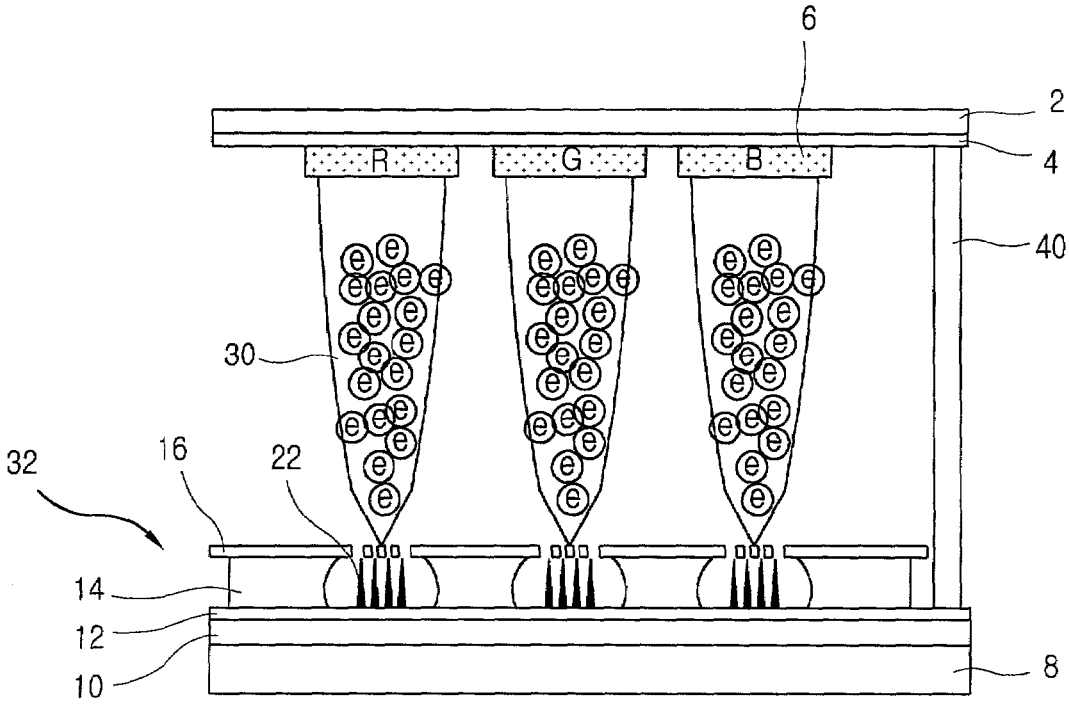
FIG. 2 CONVENTIONAL ART
FIG. 2 is a sectional view illustrating the tip type FED (field emission display) of FIG. 1.
Figure 3A:
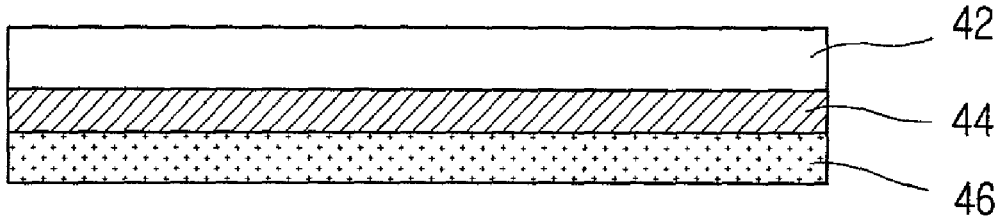
FIG. 3A CONVENTIONAL ART
FIGS. 3A and 3B illustrate a pixel cell of the conventional MIM (metal insulator metal) type FED (field emission display)
Figure 3B:
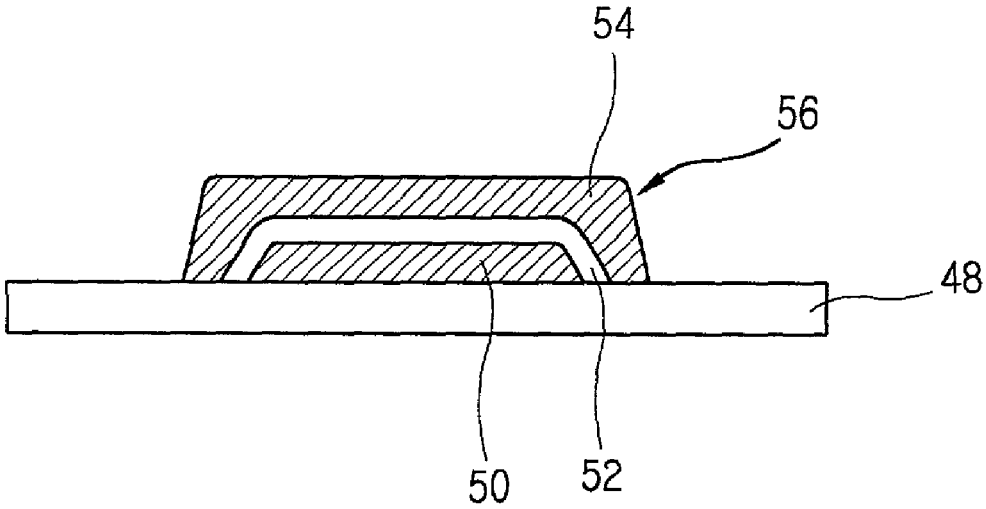
Figure 4:
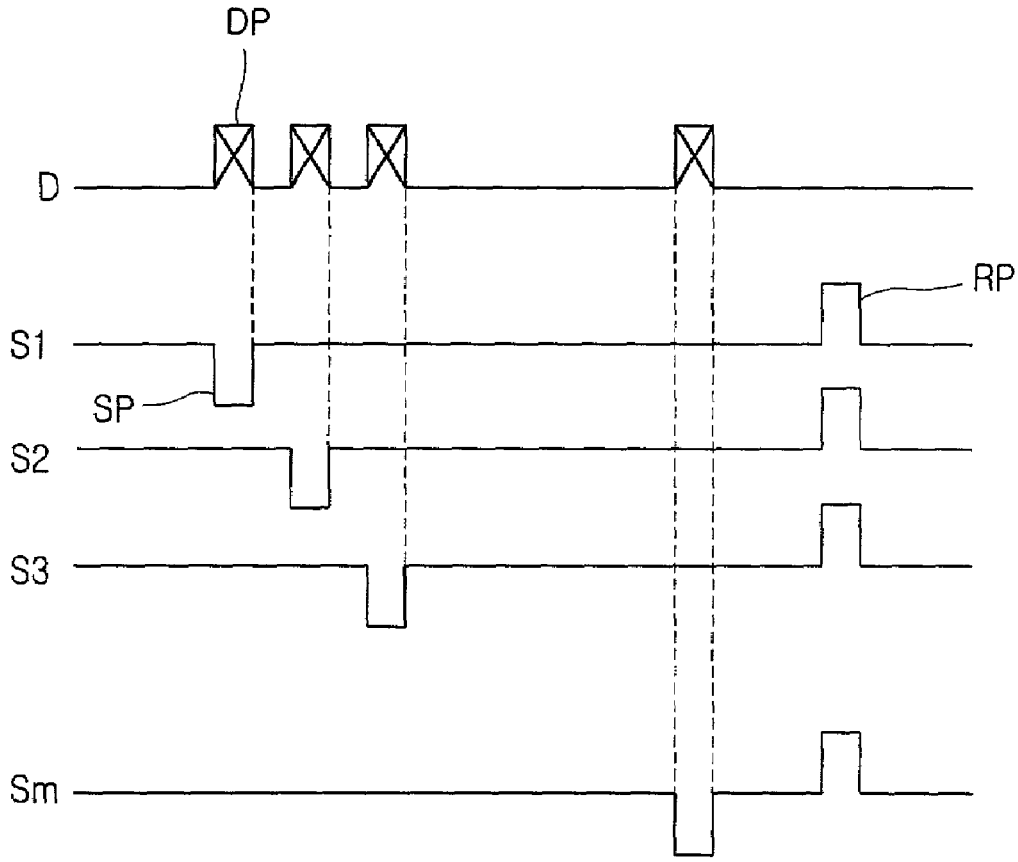
FIG. 4 is a wave diagram illustrating an operational wave supplied to the conventional MIM type FED (field emission display)
Figure 5:
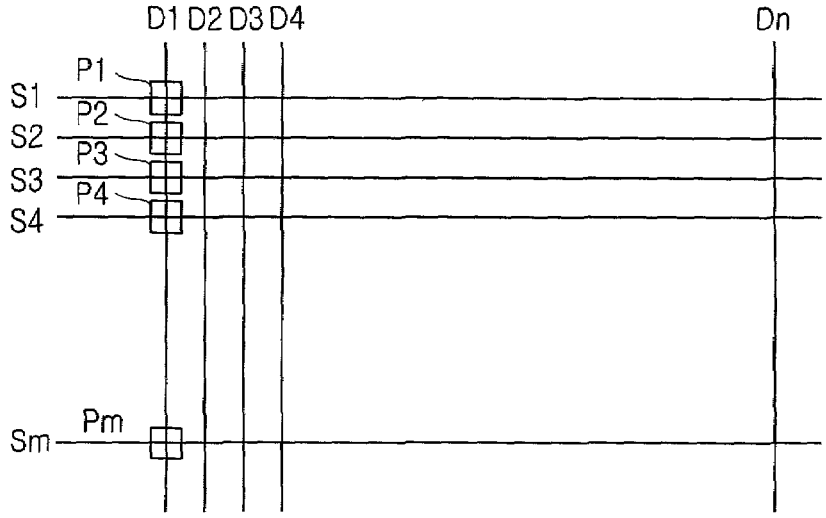
FIG. 5 illustrates a FED (field emission display) at which pixel cells of FIGS. 3A and 3B are arranged as a matrix format.
Figure 6:
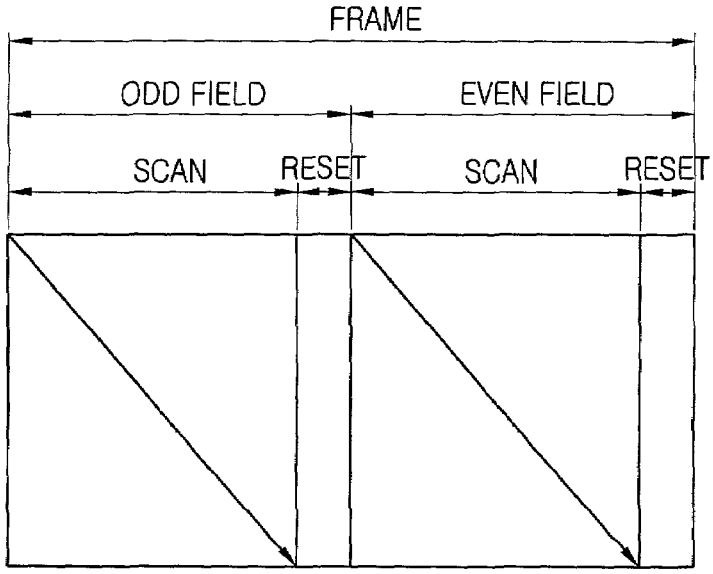
FIG. 6 illustrates one frame of a MIM (metal insulator metal) type FED (field emission display) in accordance with an embodiment of the present invention.

FIG. 6 illustrates one frame of a MIM (metal insulator metal) type FED ( field emission display) in accordance with an embodiment of the present invention.

As depicted in FIG. 6, a frame of MIM (metal insulator metal) type FED (field emission display) in accordance with an embodiment of the present invention is divided into an odd field and an even field. Each of an odd field and an even field is divided into a scan period and a reset period. It will be described in detail with reference to accompanying FIGS. 7~9.

Figure 7:
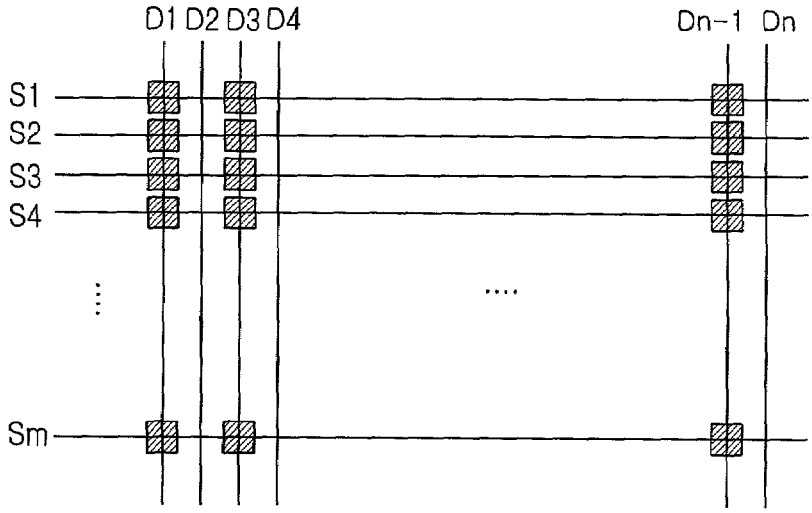
FIG. 7 illustrates pixel cells operated for an odd field period of FIG. 6.

FIG. 7 illustrates pixel cells operated for an odd field period of FIG. 6.

Figure 8:
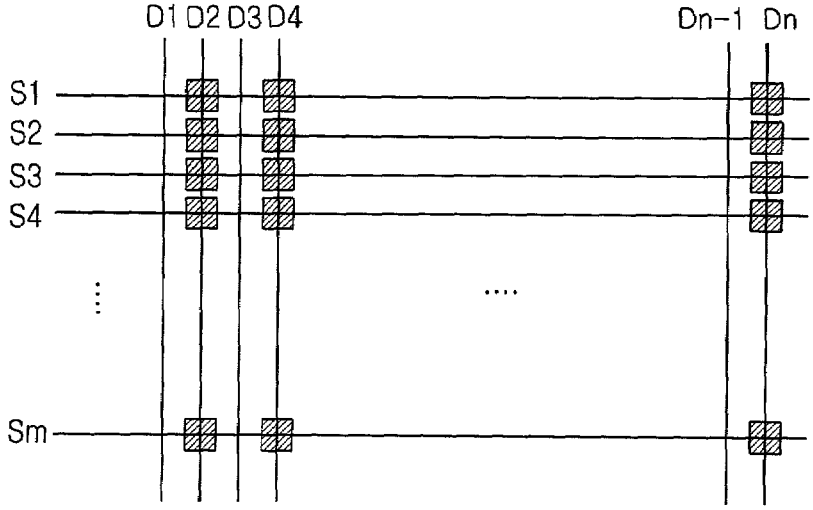
FIG. 8 illustrates pixel cells operated for an even field period of FIG. 6.

FIG. 8 illustrates pixel cells operated for an even field period of FIG. 6.

Figure 9:
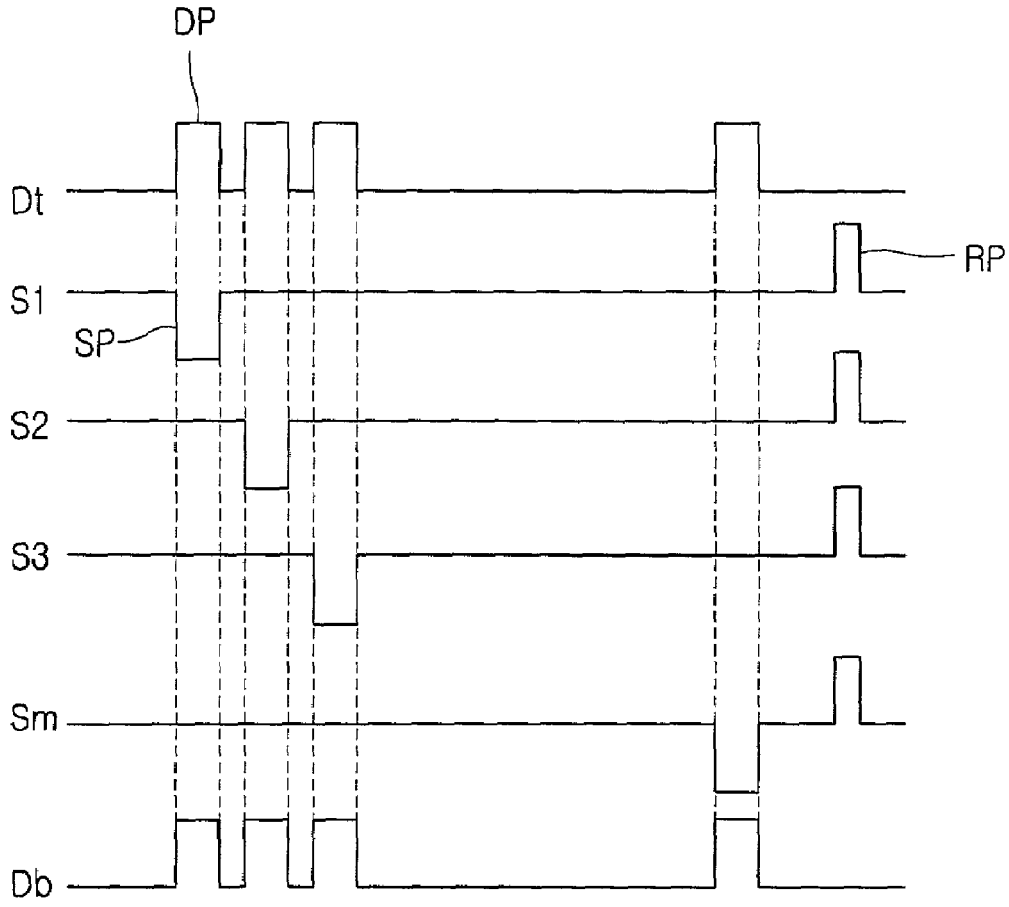
FIG. 9 is a wave diagram illustrating an operation wave applied to electrodes for one frame of FIG. 6.

FIG. 9 is a wave diagram illustrating an operation wave applied to electrodes for one frame of FIG. 6.

First, as depicted in FIGS. 7~9, for a scan period of an odd field, a scan pulse (SP) is sequentially supplied to scan lines (S). When the scan pulse (SP) is supplied to the scan lines (S), a data pulse (DP) is supplied to odd-numbered data lines (D1, D3, . . . , Dn−1). Herein, the data pulse (DP) is not supplied to even-numbered data lines (D2, D4, . . . , Dn). For that, in the present invention, the odd-numbered data lines (D1, D3, . . . , Dn−1) and the even-numbered data lines (D2, D4, . . . , Dn) are separately operated. In the reset period, a reset pulse (RP) is sequentially supplied to the scan lines (S), accordingly electric charges charged in pixel cells are eliminated.

As depicted in FIGS. 8 and 9, in the scan period of the even-numbered field, the scan pulse (SP) is sequentially supplied to the scan lines (S). When the scan pulse (SP) is supplied to the scan lines (S), the data pulse (DP) is supplied to the even-numbered data lines (D2, D4, . . . , Dn). Herein, the data pulse (DP) is not supplied to the odd-numbered data lines (D1, D3, . . . , Dn−1). In the reset period, the reset pulse (RP) is sequentially supplied to the scan lines (S), accordingly electric charges charged in pixel cells are eliminated.

In the present invention, by separately operating the data lines (D) by sub fields, a capacitance is half of a capacitance of the conventional MIM (metal insulator metal) type FED (field emission display). For example, when the scan pulse (SP) is supplied to a MIM (metal insulator metal) type FED (field emission display) of 1920×480, the data pulse (DP) is supplied to 960 pixel cells. In more detail, a capacitance of a scan line (S) receiving the scan pulse (SP) and the data pulse (DP) has a capacitance adding all capacitance values of the 960 pixel cells. Accordingly, because the MIM type FED in accordance with the present invention has a capacitance value as a half of a capacitance of the conventional MIM type FED, it can perform a high velocity operation. In addition, because a high current is required by a high capacitance element, a voltage lowering caused by a scan line operation voltage lowering due to a current value of scan lines (S) (herein, S is S1~Sm) and an electrode resistance can be prevented. Accordingly, uniformity of cells can be improved.

In the meantime, in the present invention, one frame is divided into two sub fields and operated separately, one frame period may be increased in comparison with the conventional art. In order to prevent it, in the present invention, a pulse width of the scan pulse (SP) and the reset pulse (RP) is set not greater than a half of a pulse width of a scan pulse and a reset pulse in the prior art.

Figure 10:
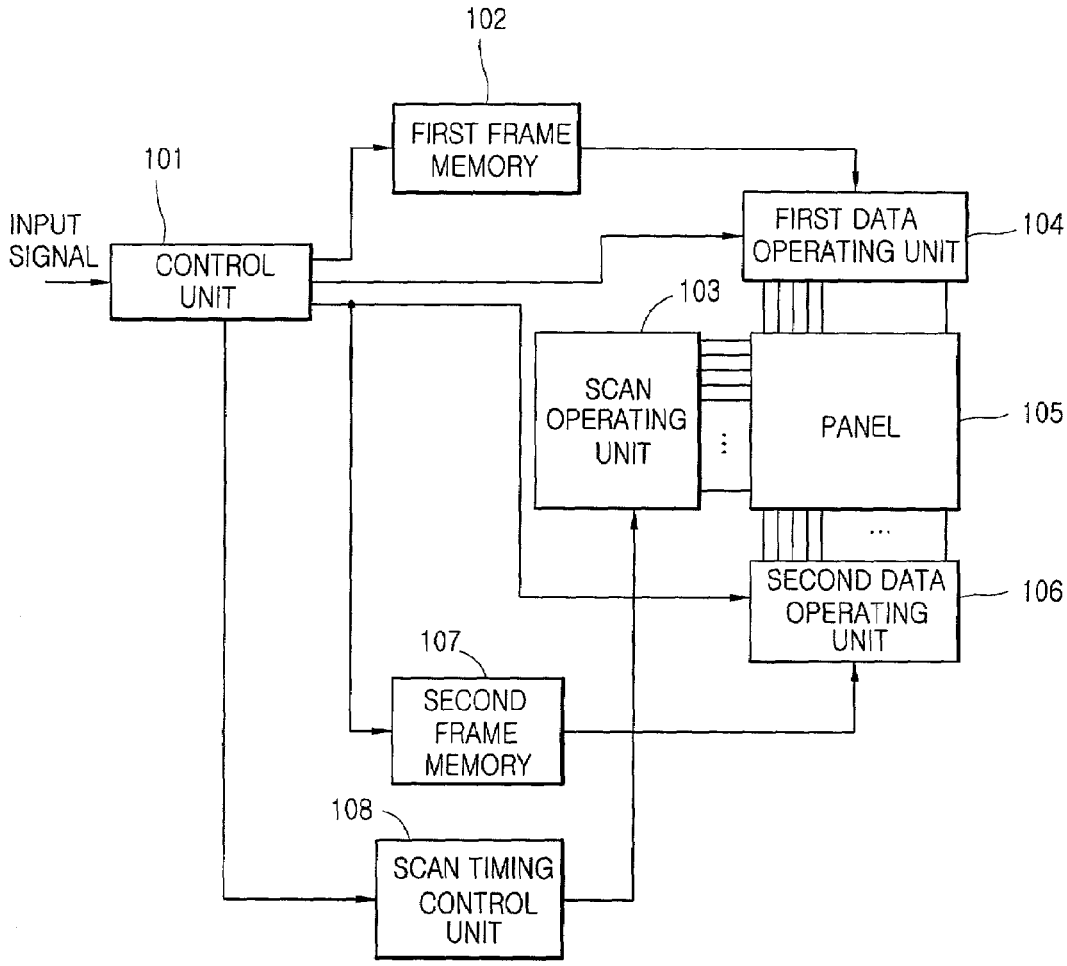
FIG. 10 illustrates an operation unit of a MIM (metal insulator metal) type FED (field emission display) in accordance with a first embodiment of the present invention.

FIG. 10 illustrates an operation unit of a MIM (metal insulator metal) type FED (field emission display) in accordance with a first embodiment of the present invention.

As depicted in FIG. 10, an operation unit of the MIM (metal insulator metal) type FED (field emission display) in accordance with the present invention is constructed with a flat panel 105, a first data operating unit 104 for supplying odd data to odd-numbered data lines (D1, D3, . . . , Dn−1) of the panel 105, a second data operating unit 106 for supplying even data to even-numbered data lines (D2, D4, . . . , Dn) of the panel 105, a scan operating unit 106 for supplying a scan pulse to scan lines (S) of the panel 105, a first frame memory 102 for temporarily storing the odd data, a second frame memory 107 for temporarily storing the even data, a scan timing control unit 108 for controlling a timing of the scan operating unit 103, and a control unit 101 for receiving an input signal from outside.

The first data operating unit 104 is electrically contacted to the odd-numbered data lines (D1, D3, . . . , Dn−1). The second data operating unit 106 is electrically contacted to the even-numbered data lines D2, D4, . . . , Dn). In the present invention, the even-numbered data lines (D2, D4, . . . , Dn) are contacted to the first data operating unit 104, and the odd-numbered data lines (D1, D3, . . . , Dn−1) are contacted to the second data operating unit 106.

The control unit 101 receives an input signal from outside. The input signal includes a picture signal and a synchronization signal. The control unit 101 divides the input signal into picture data and a synchronization signal. The control unit 101 generates a first control signal, a second control signal and a third control signal on the basis of the synchronization signal. The first control signal is supplied to the scan timing operating unit 108. The second control signal is supplied to the first data operating unit 104. The third control signal is supplied to the second data operating unit 106. In the picture data divided in the control unit 101, odd (odd-numbered) data is temporarily stored in the first frame memory 102, and even (even-numbered) data is temporarily stored in the second frame memory 107.

The odd (odd-numbered) data stored in the first frame memory 102 is synchronized with a clock signal (not shown) and transmitted to the first data operating unit 104. The even (even-numbered) data stored in the second frame memory 107 is synchronized with a clock signal (not shown) and transmitted to the second data operating unit 106.

The first data operating unit 104 supplies the odd data to the odd data lines (D1, D3, . . . , Dn−1) by the second control signal. Herein, the scan timing control unit 108 receiving the first control signal operates the scan operating unit 103, and the scan operating unit 103 supplies a scan pulse (SP) to the scan lines (S).

The second data operating unit 106 supplies the even data to the even-numbered data lines (D2, D4, . . . , Dn) by the third control signal. Herein, the scan timing control unit 108 receiving the first control signal operates the scan operating unit 103, and the scan operating unit 103 supplies a scan pulse (SP) to the scan lines (S).

In more detail, the control unit 101 alternately supplies the second and the third control signals to the first data operating unit 104 and the second data operating unit 106 and supplies the first control signal to the scan timing operating unit 108 whenever it supplies the second and the third control signals, accordingly one frame is separately operated as an odd field and an even field.

Figure 11:
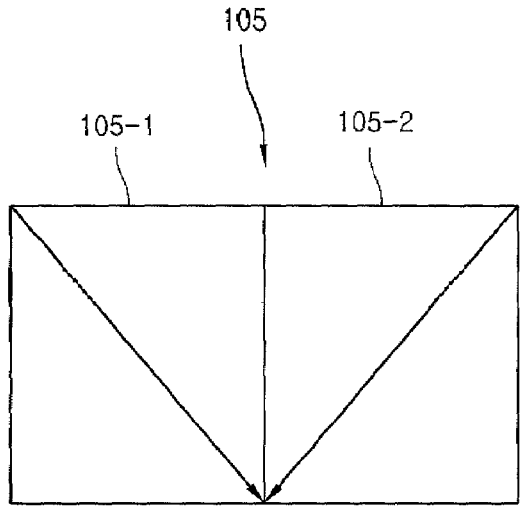
FIGS. 11 and 12 illustrate an operation method of a MIM (metal insulator metal) type FED (field emission display) in accordance with a second embodiment of the present invention.

FIGS. 11 illustrates an operation method of a MIM (metal insulator metal) type FED (field emission display) in accordance with a second embodiment of the present invention.

Figure 12:
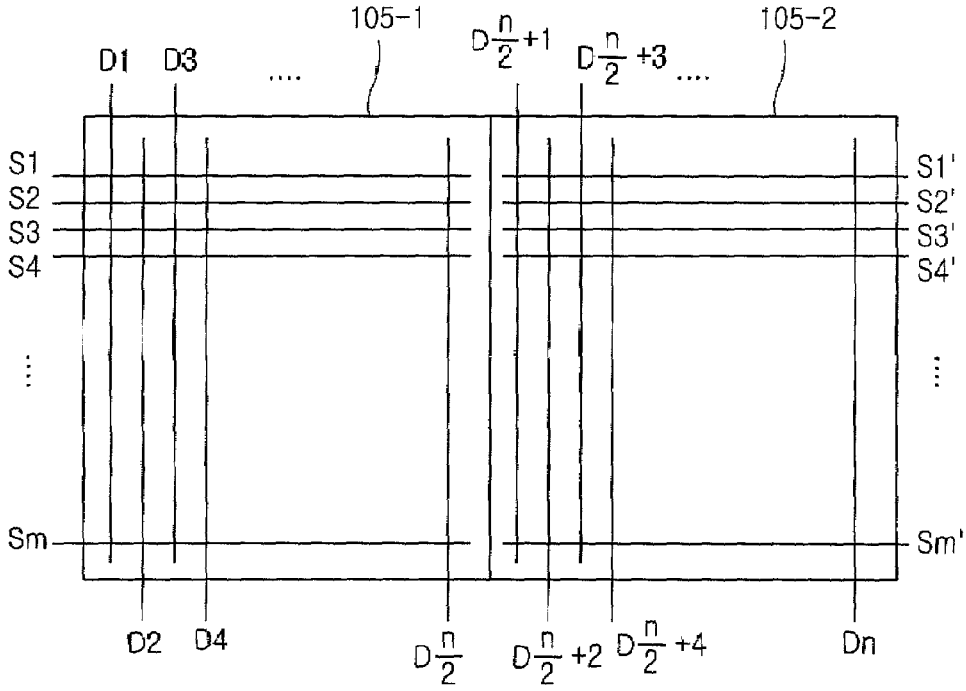

As depicted in FIGS. 11 and 12, a MIM (metal insulator metal) type FED (field emission display) in accordance with a second embodiment of the present invention divides a panel 105 into a left region 105-1 and a right region 105-2 and operates separately. The left region 105-1 and the right region 105-2 of the panel 105 are separately operated. For that, scan electrodes (S) formed at the left region 105-1 and scan electrodes (S') formed at the right region 105-2 are insulated each other. In addition, data electrodes (D) formed at the left region 105-1 and the right region 105-2 are insulated each other.

'n'~'n/2' number of data electrodes (D1~Dn/2) are formed at the left region 105-1. n/2+1~'n' number of data electrodes (Dn/2+1~Dn) are formed at the right region 105-2. The data electrodes (D) formed at the left region 105-1 and the right region 105-2 are divided into odd-numbered lines and even-numbered lines and separately operated. The operation process will be described in more detail.

First, a scan pulse is supplied to first scan electrodes (S1, S1') formed at the left region 105-1 and the right region 105-2. A data pulse is supplied to the first and the n/2+1 data electrodes (D1, Dn/s+1) by being synchronized with the scan pulse supplied to the first scan electrodes (S1, S1'). Herein, pixel cells receiving the scan pulse and the data pulse emit electrons, accordingly a picture is displayed.

After that, by repeating the above-described process, a scan pulse and a data pulse are sequentially applied up to mth scan electrodes (Sm, Sm') formed at the left region 105-1 and the right region 105-2, accordingly a picture is displayed. After displaying the picture, a reset pulse is applied to the scan electrodes (S, S') formed at the left region 105-1 and the right region 105-2, accordingly electric charges charged in pixel cells are eliminated.

In more detail, by dividing the panel 105 into the left region 105-1 and the right region 105-2 and separately operating them, a capacitance can be lowered. For example, in a panel of 1920×480, 960 pixel cells are formed at each scan electrode (S) at the left region 105-1, and 960 pixel cells are formed at each scan electrode (S') at the left region 105-2. Accordingly, when the scan pulse and the data pulse are applied, the scan electrodes (S, S') at the left region 105-1 and the right region 105-2 have a capacitance value of 960 pixel cells. In more detail, the MIM (metal insulator metal) type FED (field emission display) in accordance with the present invention has a capacitance value as a half of a capacitance value of the conventional MIM type FED. Because a capacitance value is lowered, the MIM type FED in accordance with the present invention can perform a high velocity operation.

Figure 13:
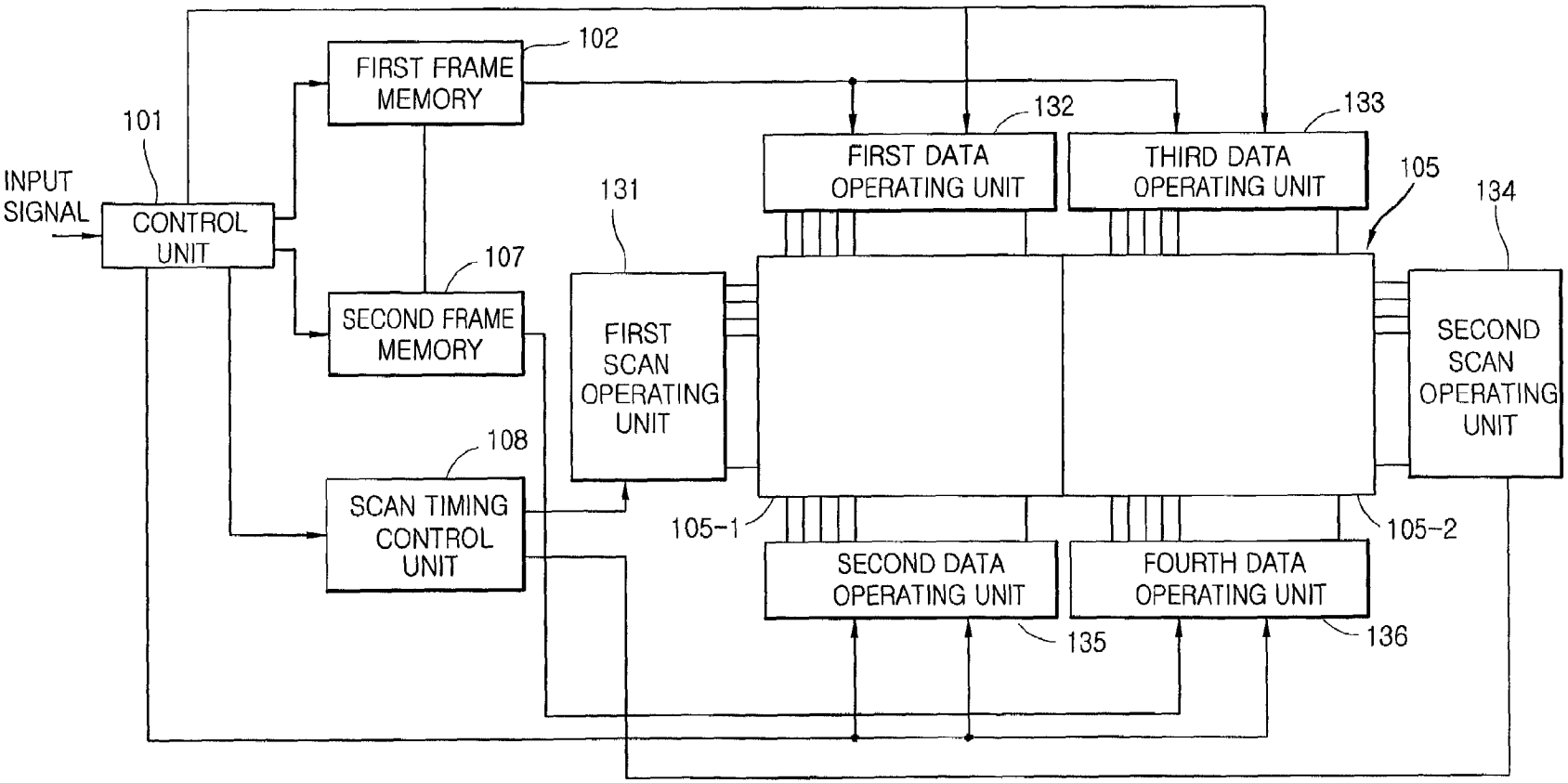
FIG. 13 illustrates an operation unit of the MIM (metal insulator metal) type FED (field emission display) in accordance with the second embodiment of the present invention.

FIG. 13 illustrates an operation unit of the MIM (metal insulator metal) type FED (field emission display) in accordance with the second embodiment of the present invention.

As depicted in FIG. 13, an operation unit of the MIM (metal insulator metal) type FED (field emission display) in accordance with the second embodiment of the present invention includes a panel 105, a first~a urth data operating units 132, 135, 133, 136 for operating data electrodes (D), a first and a second scan operating units 131, 134 for operating scan electrodes (S, S'), a first frame memory 102 for temporarily storing odd-numbered data, a second frame memory 107 for temporarily storing even-numbered data, a scan timing control unit 108 for controlling a timing of the first and the second scan operating units 131, 134 and a control unit 101 for receiving an input signal from outside. The operation of the operation unit of the MIM (metal insulator metal) type FED (field emission display) in accordance with the second embodiment of the present invention will be described in detail.

First, the first data operating unit 132 operates odd-numbered data electrodes (D1, D3, . . . , Dn/2−1) formed at the left region 105-1. The third data operating unit 133 operates odd-numbered data electrodes (Dn/2+1, Dn/2+3, . . . , Dn −1) formed at the right region 105-2. The second data operating unit 135 operates even-numbered data electrodes (D2, D4, . . . , Dn/2) formed at the left region 105-1. The fourth data operating unit 136 operates even-numbered data electrodes (Dn/2+2, Dn/2+4, . . . , Dn) formed at the right region 105-2.

The first scan operating unit 131 operates the scan electrodes (S) formed at the left region 105-1. The second scan operating unit 134 operates the scan electrodes (S') formed at the right region 105-2.

The first frame memory 102 temporarily stores odd (odd-numbered) data and supplies stored data to the first and the third data operating units 132, 133. The second frame memory 107 temporarily stores even (even-numbered) data and supplies stored data to the second and the fourth data operating units 135, 136.

The scan timing control unit 108 controls an operational timing of the first and the second scan operating units 131, 134. The control unit 101 controls the first frame memory 102, the second frame memory 107 and the first~the fourth data operating units 132, 135, 133, 136. The operation process will be described in detail.

First, the control unit 101 receives an input signal including picture data and a synchronization signal from outside. The control unit 101 divides the picture data and the synchronization signal of the input signal. The control unit 101 generates a first control signal, a second control signal and a third control signal on the basis of the synchronization signal. Herein, the first control signal is supplied to the scan timing operating unit 108. The second control signal is supplied to the first and the third data operating units 132, 133. The third control signal is supplied to the second and the fourth data operating unit 135, 136. In the picture data divided in the control unit 101, odd (odd-numbered) data is temporarily stored in the first frame memory 102, and even (even-numbered) data is temporarily stored in the second frame memory 107.

The odd data stored in the first frame memory 102 is synchronized with a clock signal (not shown) and transmitted to the first and the third data operating unit 132, 133. The even data stored in the second frame memory 107 is synchronized with a clock signal (not shown) and transmitted to the second and the fourth data operating unit 135, 136.

The first data operating unit 132 supplies odd data to the odd data electrodes (D1, D3, . . . , Dn/2−1) by the second control signal. Herein, the third data operating unit 133 supplies even data to the even-numbered data electrodes (Dn/2+1, Dn/2+3, . . . , Dn −1) formed at the right region 105-2 by the third control signal.

The second data operating unit 135 supplies even data to the even-numbered data electrodes (D2, D4, . . . , Dn/2) formed at the left region 105-1 by the third control signal. The fourth data operating unit 136 supplies even data to the even-numbered data electrodes (Dn/2+2, Dn/2+4, . . . , Dn) formed at the right region 105-2 by the third control signal.

The scan timing control unit 108 operates the first and the second scan operating units 131, 134 by the first control signal. Herein, the first and the second scan operating units 131, 134 and the first~the fourth data operating units 132, 135, 133, 136 are synchronized. In more detail, the first and the second scan operating units 131, 134 supply a scan pulse to the scan electrodes (S, S') so as to synchronize with a data pulse supplied from the first ~ the fourth data operating units 132, 135, 133, 136 to the data electrodes (D).

In the meantime, in the operation of the MIM (metal insulator metal) type FED (field emission display) of 1920×480, each of the first~the fourth data operating units 132, 135, 133, 136 has 480 data pins. In more detail, in the MIM (metal insulator metal) type FED (field emission display) in accordance with the present invention, because the number of data pins formed at one operation unit is reduced in comparison with the conventional MIM (metal insulator metal) type FED (field emission display), it facilitates fabrication of a MIM (metal insulator metal) type FED (field emission display) having a high resolution.

As described above, in a flat panel display and an operation method thereof in accordance with the present invention, one frame is divided into an odd field and an even field, and the odd field and the even field are separately divided. In the odd field, a data pulse is supplied to odd-numbered data lines, and in the even field, a data pulse is supplied to even-numbered data lines. In more detail, by dividing the data lines, only a half of pixel cells along scan lines receive the scan pulse and the data pulse. Accordingly, in the present invention, a capacitance value of pixel cells can be minimized, a uniformity of a screen can be improved by preventing a voltage lowering of the scan lines, accordingly it is possible to perform a high velocity operation.

In addition, in a flat panel display and an operation method thereof in accordance with the present invention, a panel is divided into a left region and a right region. 'n'~'n/2' number of data electrodes are formed at the right region, and 'n/2+1'~'n' number of data electrodes are formed at the left region. In more detail, by dividing the panel perpendicularly, a capacitance of pixel cells formed at the scan electrode can be lowered, accordingly it is possible to perform a high velocity operation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A flat panel display, comprising:

data electrodes;

first scan electrodes formed at a left region of a panel so as to cross the data electrodes;

second scan electrodes formed at a right region of the panel so as to be aligned with the first scan electrodes and cross the data electrodes, wherein each of the first scan electrodes and its respective aligned second scan electrode together form a common scan line;

a first data operating unit for supplying odd data to odd-numbered data electrodes formed at the left region, the first data operating unit supplying the odd data during an odd field of one frame;

a second data operating unit for supplying even data to even-numbered data electrodes formed at the left region, the second data operating unit supplying the even data during an even field of the one frame, the even field of the one frame being different than the odd field of the one frame;

a third data operating unit for supplying odd data to odd-numbered data electrodes formed at the right region, the third data operating unit supplying the odd data during the odd field of the one frame; and a fourth data operating unit for supplying even data to even-numbered data electrodes formed at the right region, the fourth data operating unit supplying the even data during the even field of the one frame.

2. The flat panel display of claim 1, wherein the first scan electrodes and the second scan electrodes are insulated from each other.

3. The flat panel display of claim 1, wherein data electrodes designated as 1 through n/2 are formed at the left region, and data electrodes designated as (n/2)+1 through n are formed at the right region.

4. The flat panel display of claim 1, further comprising:

a first scan operating unit for operating the first scan electrodes; and a second scan operating unit for operating the second scan electrodes.

5. The flat panel display of claim 4, further comprising:

a scan timing control unit for controlling an operational timing of the first and the second scan operating units;

a first frame memory for storing the odd data;

a second frame memory for storing the even data; and a control unit for supplying the odd data and the even data to the first and the second frame memories and supplying control signals for controlling the first through the fourth data operating units and the scan timing control unit.

6. The flat panel display of claim 5, wherein the control unit supplies a first control signal for operating the first and the third data operating units, a second control signal for operating the second and the fourth data operating units so as to be synchronized with the first control signal and a third control signal to the scan timing control unit in order to make the first and the second scan operating units supply a scan pulse when a data pulse is supplied to the first through the fourth data operating units.

7. The flat panel display of claim 1, wherein the flat panel display comprises a field emission display.

8. The flat panel display of claim 1, wherein the one frame includes the odd field and the even field, the odd field including a first scan period and a first reset period, the even field including a second scan period and a second reset period.

9. A flat panel display, comprising:

a panel divided into a left region and a right region;

data electrodes formed at the left region;

data electrodes formed at the right region;

first scan electrodes formed at the left region so as to cross the data electrodes formed at the left region;

second scan electrodes formed at the right region so as to be aligned with the first scan electrodes and cross the data electrodes formed at the right region, wherein each of the first scan electrodes and its respective second scan electrode together form a common scan line;

a first data operating unit for supplying odd data to odd-numbered data electrodes formed at the left region, the first data operating unit supplying the odd data during an odd field of one frame;

a second data operating unit for supplying even data to even-numbered data electrodes formed at the left region, the second data operating unit supplying the even data during an even field of the one frame, the even field of the one frame being different than the odd field of the one frame;

a third data operating unit for supplying odd data to odd-numbered data electrodes formed at the right region, the third data operating unit supplying the odd data during the odd field of the one frame; and a fourth data operating unit for supplying even data to even-numbered data electrodes formed at the right region, the fourth data operating unit supplying the even data during the even field of the one frame.

10. The flat panel display of claim 9, wherein the first scan electrodes and the second scan electrodes are insulated from each other.

11. The flat panel display of claim 9, wherein data electrodes designated as 1 through n/2 are formed at the left region, and data electrodes designated as (n/2)+1 through n are formed at the right region.

12. The flat panel display of claim 9, further comprising:

a first scan operating unit for operating the first scan electrodes; and a second scan operating unit for operating the second scan electrodes.

13. The flat panel display of claim 12, further comprising:

a scan timing control unit for controlling an operational timing of the first and the second scan operating units;

a first frame memory for storing the odd data;

a second frame memory for storing the even data; and a control unit for supplying the odd data and the even data to the first and the second frame memories and supplying control signals for controlling the first through the fourth data operating units and the scan timing control unit.

14. The flat panel display of claim 13, wherein the control unit supplies a first control signal for operating the first and the third data operating units, a second control signal for operating the second and the fourth data operating units so as to be synchronized with the first control signal, and a third control signal to the scan timing control unit in order to make the first and the second scan operating units supply a scan pulse when a data pulse is supplied to the first through the fourth data operating units.

15. The flat panel display of claim 9, wherein the flat panel display comprises a field emission display.

16. The flat panel display of claim 9, wherein the one frame includes the odd field and the even field, the odd field including a first scan period and a first reset period, the even field including a second scan period and a second reset period.

17. A display, comprising:

data electrodes; and first scan electrodes positioned to cross the data electrodes;

second scan electrodes positioned to cross the data electrodes;

a first data operating unit to supply odd data to odd-numbered data electrodes formed at a first region of the display, the first data operating unit to supply the odd data during an odd field of one frame;

a second data operating unit to supply even data to even-numbered data electrodes formed at the first region of the display, the second data operating unit to supply the even data during an even field of the one frame, the even field of the one frame being different than the odd field of the one frame;

a third data operating unit to supply odd data to odd-numbered data electrodes formed at a second region of the display, the third data operating unit to supply the odd data during the odd field of the one frame; and a fourth data operating unit to supply even data to even-numbered data electrodes formed at the second region of the display, the fourth data operating unit to supply the even data during the even field of the one frame.

18. The display of claim 17, wherein data electrodes designated as 1 through k are formed at the first region of the display, and data electrodes designated as (k+1) through n are formed at another region, wherein k and n are integers.

19. The display of claim 17, wherein the display comprises a field emission display.

20. The display of claim 17, wherein the one frame includes the odd field and the even field, the odd field including a first scan period and a first reset period, the even field including a second scan period and a second reset period.

* * * * *